United States Patent [19]

Nishiuchi

[11] Patent Number: 4,499,370

[45] Date of Patent: Feb. 12, 1985

[54] ZERO-RESET TYPE COUNTER

[75] Inventor: Toshio Nishiuchi, Kashiwa, Japan

[73] Assignee: Dai-Ichi Seiko Co., Ltd., Kawaguchi, Japan

[21] Appl. No.: 554,710

[22] Filed: Nov. 23, 1983

[30] Foreign Application Priority Data

Jul. 29, 1983 [JP] Japan ..... 58-137854

[51] Int. Cl.[3] ..... G06C 15/42

[52] U.S. Cl. ..... 235/144 HC; 235/1 C; 235/139 A; 235/117 R

[58] Field of Search ..... 235/1 C, 133 R, 134, 235/136, 139 R, 139 A, 144 R, 144 HC, 144 SM, 144 PN, 117 R

[56] References Cited

U.S. PATENT DOCUMENTS

| | | | |
|---|---|---|---|
| 2,117,024 | 5/1938 | Helgeby et al. | 235/139 A |
| 3,432,096 | 3/1969 | Powell | 235/139 A X |
| 3,630,436 | 12/1971 | Sanz et al. | 235/136 |
| 3,945,563 | 3/1976 | Inoue | 235/139 R X |

*Primary Examiner*—Benjamin R. Fuller

*Attorney, Agent, or Firm*—Cushman, Darby & Cushman

[57] ABSTRACT

A zero-reset type counter comprising an order shift pinion built in an inner space formed between two adjacent digit wheels in order to make the space between the adjacent digit wheels as small as possible and to form a compact counter as a whole. The zero reset lever to pivot the order shift pinion is so arranged as to be able to fill up the gap between adjacent digit wheels.

4 Claims, 10 Drawing Figures

ZERO-RESET TYPE COUNTER

BACKGROUND OF THE INVENTION (a) Field of the Invention

The present invention relates to a zero-reset type counter provided with digit wheels, an order shift mechanism and a zero reset mechanism.

(b) Description of the Prior Art

Recently, the counters of this sort are extensively used as a portable adder or as a tripmeter in a tape recorder, automobile and the like. However, the most of them, as their respective digit wheels are so arranged as to have a certain intervals due to their mechanical structure, have such a defect that their lateral width is large for their number of figures and have an external appearance not so preferable. Further, in the counters of this sort, the zero reset is generally effected by pressing down an eccentric cam formed integrally with a digit wheel with a swingable lever. However, in this type of mechanism wherein the above mentioned lever and the order shift pinion group are formed as one assembly and this assembly is disposed parallely on the outer portion of the digit wheel group, the size of the whole counter device becomes so large as not to be apt to manufacture a miniature counter of this sort.

Conventionally, in order to delete these defects, a counter of such a type wherein, for example, as disclosed in Japanese Patent Publication No. 42912/1976, zero reset plates movable to the vertical direction are interposed between respective digit wheels and the order shift pinion group is entirely housed inside the digit wheels by making these zero reset plates pivot the order shift pinions has been proposed. However, this type of counter has a problem in the mass production due to the difficulty in assemblage.

SUMMARY OF THE INVENTION

The primary object of the present invention is, in view of the above mentioned circumstances, to provide a zero reset type counter so formed as to be easy to assemble and apt for a mass production and of which the order shift pinion group is entirely housed inside the digit wheels.

According to the present invention, this object is attained by forming an annular recess having an internal gear on one side of each digit wheel and an annular recess having order shift teeth and an eccentric cam on the other side, arranging each digit wheel rotatably on a common supporting shaft so that the above mentioned recesses are respectively facing to each other, interposing between two adjacent digit wheels a zero reset lever fixed on a rotary shaft disposed adjacent to the digit wheel group and able to forcibly return each digit wheel to the zero indicating position through making a contact with the above mentioned eccentric cam, pivoting a pinion to mesh with the above mentioned internal gear on one side of said zero reset lever and an order shift pinion to mesh with the order shift teeth on the other side so that they are rotatable integrally with each other and housing them inside the space formed by the above mentioned recesses.

According to a preferable formation of the present invention, the order shift teeth are consisting of two driving teeth and a pair of regulating teeth adjacent to the driving teeth, an idling face and a controlling face intersecting thereto at right angles are formed along the inner circumference between the pair of regulating teeth on each digit wheel, the teeth of the order shift pinions are so thinly formed as to be able to be placed on the above mentioned idling face every other piece and the tops of the pair of teeth adjacent to the thin teeth of the order shift pinion are so formed as to be able to be engaged with the above mentioned controlling face except at the order shift. The zero reset lever is selected to have such a thickness as to be able to fill up the gap between a pair of digit wheels adjacent each other.

According to the present invention, as the order shift pinion is able to be entirely housed inside the space formed by the recesses of the pair of digit wheels adjacent each other through the zero reset lever, it is able to form the whole compact in comparison with a conventional one in which the order shift pinion is outwardly exposed. As the gap between the adjacent digit wheels is able to be made remarkably narrow in comparison with the conventional counter and, further, the gap is filled up with a zero reset lever in a normal status, it is able to shorten the lateral width of the counter as a whole for its number of figures or it is able to use a comparatively large numeral characters because the width of digit wheel is able to be wider when the lateral width is equal to that of the conventional counter and, consequently, it is able to have such an advantage as to be easy to read the numeral. Moreover, according to the present invention, as the order shift pinion and the rotation transmission pinion are pivoted on the zero reset lever in a pair and the order shift pinion is so formed as to be able to be locked by the countrolling face formed on the digit wheel except at the order shift, the common supporting shaft for the plurality of order shift pinions and such a position regulating rectangular boss indispensable to the order shift pinion as of the conventional counter becomes unnecessary and, consequently, the manufacture of the order shift pinion becomes easy. Further, as the order shift pinion and the rotation transmission pinion are able to be a unit by previously assembling them, the processing and assembling accuracy of components are easily improved and, consequently, not only the assemblage of the whole counter is made so easy and simple but also the increase or decrease of the number of figures is made so easy that it is able to provide a counter of this sort apt for a mass production. Further, the components are able to be easily formed by an injection molding.

This and other objects of the present invention will become more apparent during the course of the following detailed description and appended claims.

DESCRIPTION OF THE PREFERRED EMBODIMENT

Figure 1:
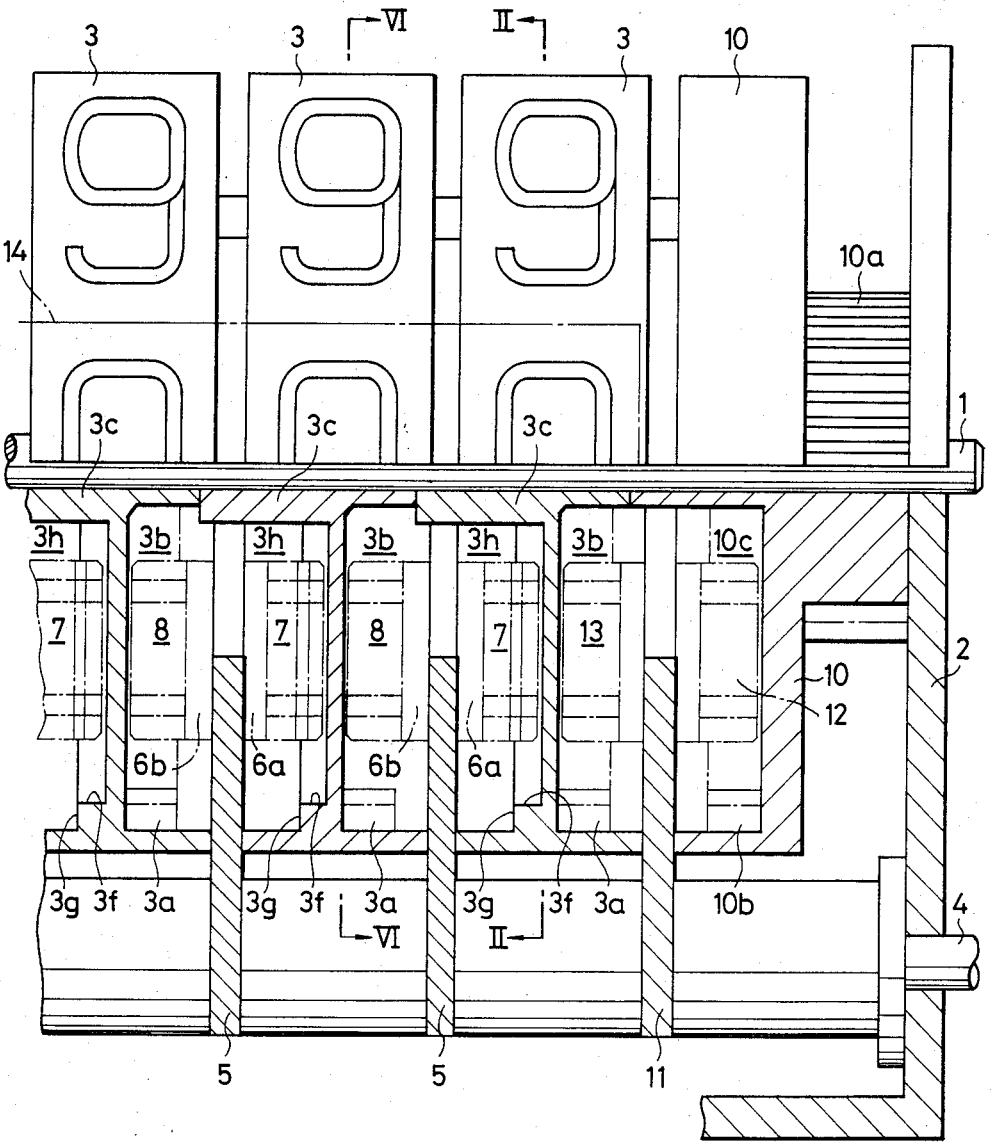
FIG. 1 is a front view of an embodiment of the counter according to the present invention in which the lower half portion is shown as a sectional view.

Referring to FIGS. 1 through 6, the reference numeral 1 is a supporting shaft laterally mounted on a counter frame 2, 3 are digit wheels each with numeral characters 0~9 printed thereon on the outer periphery thereof and rotatably mounted on the supporting shaft 1. The each digit wheel is respectively formed with an annular recess 3*b* having an internal gear 3*a* at the right side of the center wall in the position of FIG. 1 and an annular recess 3*h* having a preferably heart-shaped eccentric cam 3*c* on the center portion and a pair of driving teeth 3*d* for order shift, a pair of regulating teeth $3e_1$, $3e_2$ (see FIG. 2) disposed adjacent to the both sides of the driving teeth 3*d*, a control face 3*f* provided along the inner peripheral face of the digit wheel 3 between the regulating teeth $3e_1$, $3e_2$ and an idling face 3*g* intersecting thereto at right angles on the inner peripheral edge portion at the left side of the center wall. 4 is a shaft laterally and rotatably mounted on the counter frame 2 just under the digit wheel group, 5 is zero reset levers each fixed on the shaft 4 at its base portion, having a thickness and shape just able to be interposed between the adjacent digit wheels 3, 3 and having an inner edge 5*a* able to contact with the eccentric cam 3*c* and pins 5*b*, 5*c*, 5*d*, as clearly shown in FIG. 2. 6 is a rotary shaft rotatably supported on the zero reset lever 5 and extending from the both sides of said lever to the directions opposite each other, 7 are order shift pinions each fixed on the rotary shaft 6 and having teeth $7a_1$--$7a_4$, $7b_1$–$7b_4$ able to be meshed with the driving teeth 3*d* and, as clearly illustrated in FIG. 3, the tooth thicknesses thereof being reduced to be $\frac{1}{3}$ and $\frac{2}{3}$ respectively at every other tooth and a short tooth $7c_1$–$7c_4$ having a $\frac{1}{3}$ thickness, 8 are pinions each fixed on the rotary shaft 6 at the side opposite to the order shift pinion 7 with respect to the zero reset lever 5 and having the same number and same pitch as of the order shift pinion 7 meshed with the internal gear 3*a* of the higher order digit wheel 3 adjacent to the digit wheel meshed with the order shift pinion 7, 9 is a plate spring having a base portion fixed on the pin 5*b* of the zero reset lever 5, the central portion engaged on the pin 5*c* and the end portion on the pin 5*d* respectively, and controlling the order shift pinion 7 and the pinion 8 from easily turning by the portion between the pins 5*c* and 5*d* made to contact the tops of a pair of teeth $7b_1$–$7b_4$, $7b_1$–$7b_4$ adjacent each other of the order shift pinion 7 and, at the same time, so regulating that the pinion 8 will correctly mesh with the internal gear 3*a* when the digit wheels have been returned to the zero indicating positions. As is clear from the above explanation, the order shift pinion 7 and the pinion 8 are housed in the space formed by the recesses 3*h* and 3*b* of the adjacent digit wheels 3, 3 in the status rotatably supported on the zero reset lever 5 through the rotary shaft 6 and the zero reset lever 5 is so selected as to have the plate thickness able to fill the gap between the adjacent digit wheels. And they constitute the order shift mechanism between two adjacent digit wheels 3, 3 and the zero reset mechanism for the lower order digit wheel. Accordingly, it is needless to say that the number of digit wheels and of the above mentioned mechanisms are decided by the number of figures of the counter to be manufactured. Further, in FIG. 1, 10 is a driving wheel of the same diameter as of the digit wheel 3 rotatably mounted on the supporting shaft 1 and having an annular recess 10*c* disposed with an outer power transmission gear 10*a* and an internal gear 10*b*, 11 is a lever having a base portion fixed on the shaft 4 and almost entire portion having a thickness and shape just insertable into the gap between the driving wheel 10 and the digit wheel 3 adjacent to this, 12 and 13 are pinions so pivoted on the lever 11 as to be integrally rotatable same like the aforementioned order shift pinion 7 and pinion 8 and having the same number of teeth and pitch respectively able to be meshed with the internal gear 10*b* and 3*a*, and these are housed, as illustrated, in the space formed by the recess 10*c* of the driving wheel 10 and the recess 3*b* of the digit wheel 3. By the way, the shaft 4 is biased counterclockwise by a spring or the like not illustrated at the position shown in FIG. 2 and, in a normal status, the pinion 12 is meshed with the internal gear 10*b*, the pinion 13 with the internal gear 3*a* and the pinion 8 with the internal gear 3*a* respectively. The order shift pinion 7 is kept at the position able to be meshed with the order shift driving teeth 3*d*.

Figure 2:
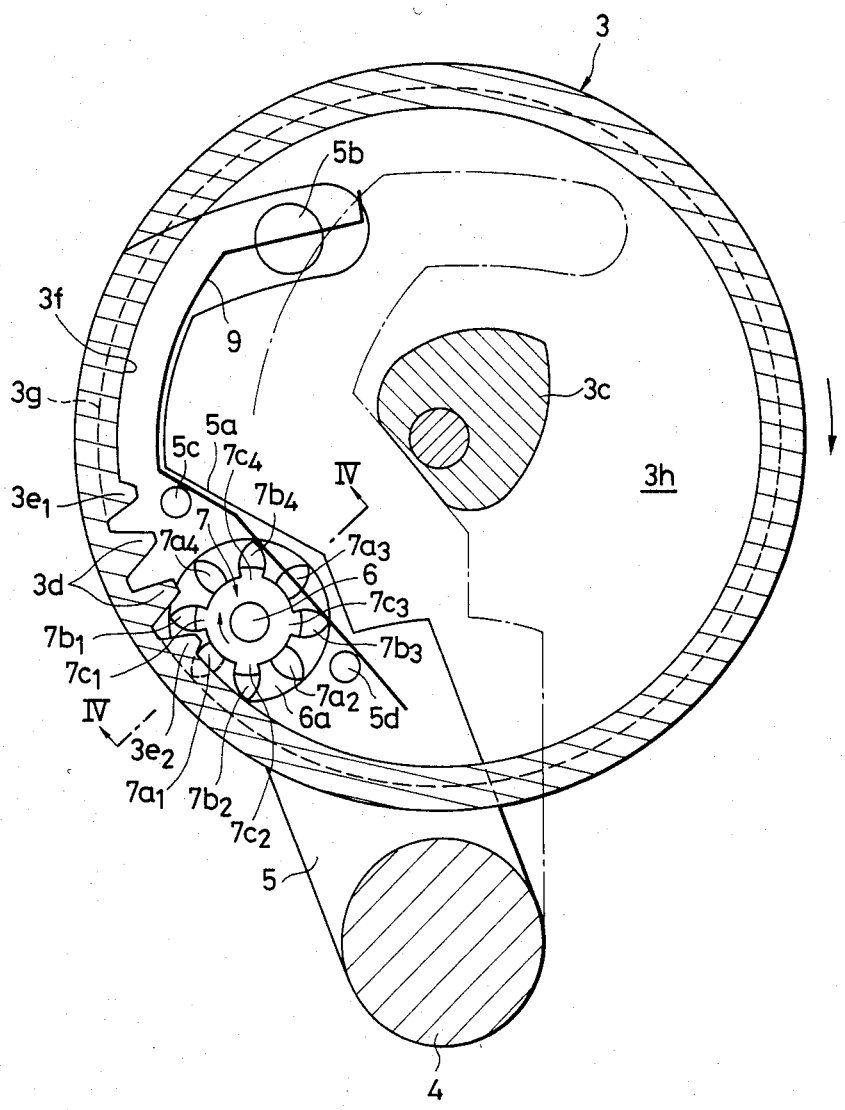
FIG. 2 is a sectional view along the II—II line of FIG. 1.
Figure 3:
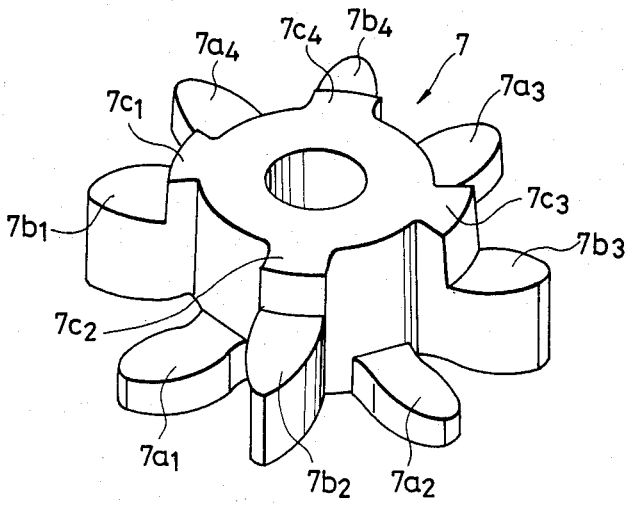
FIG. 3 is an enlarged perspective view of the order shift pinion shown in FIG. 2.
Figure 4:
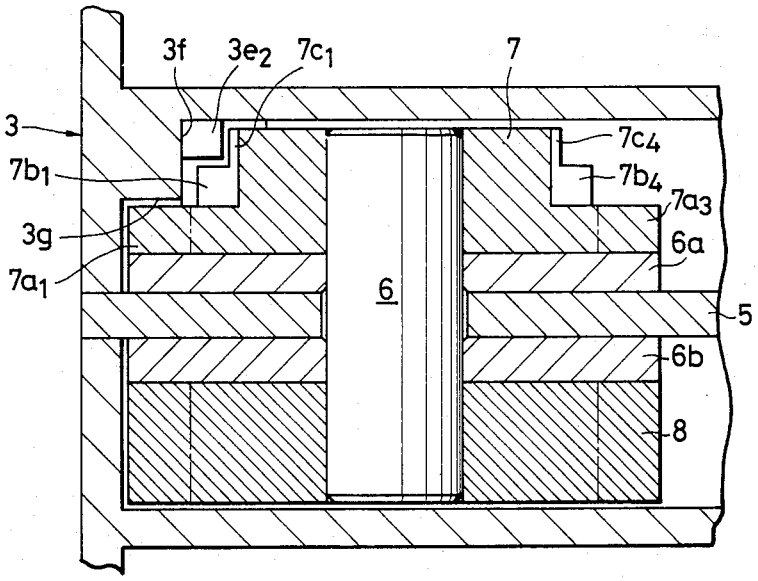
FIG. 4 is an enlarged sectional view along the IV—IV line of FIG. 2.
Figure 5:
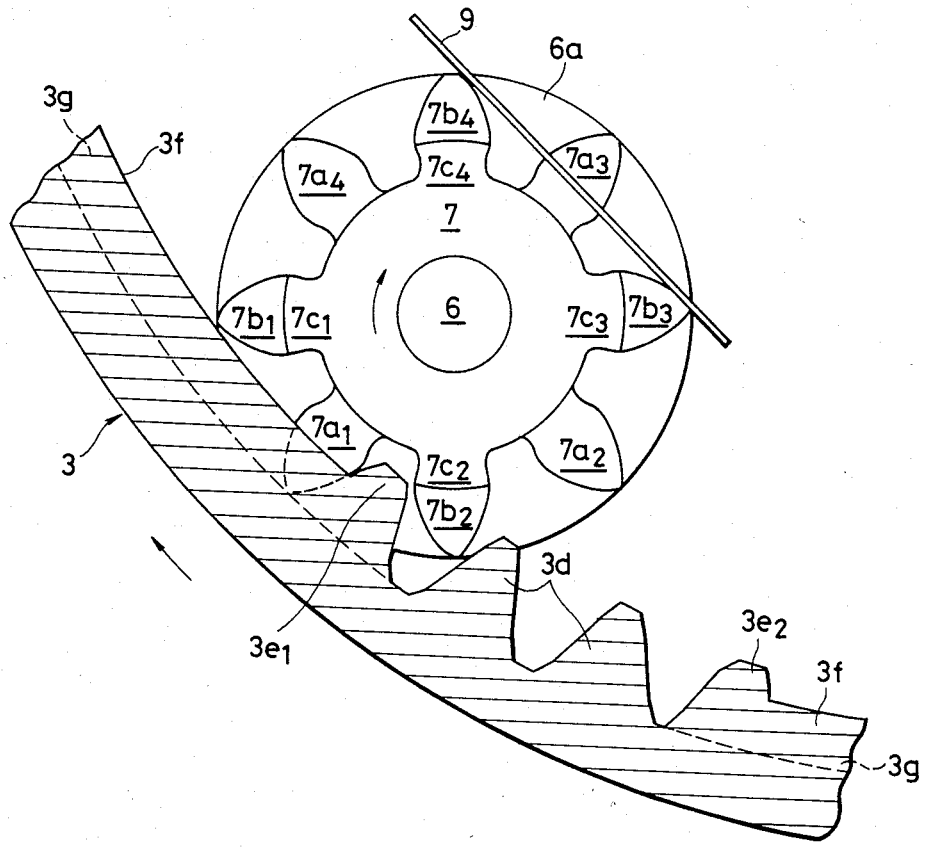
FIG. 5 is a partially enlarged view showing the relative position between the order shift pinion and order shift teeth at the end of the order shift.
Figure 6:
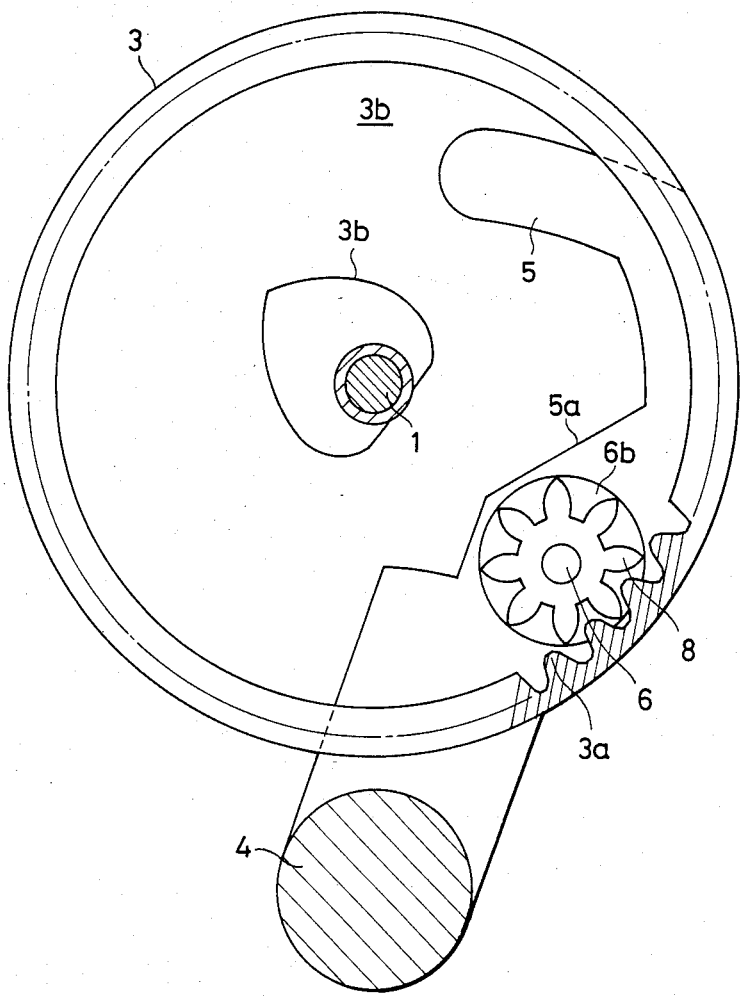
FIG. 6 is a sectional view along the VI—VI line of FIG. 1.

Next, assuming that the number of teeth of the internal gear 3*a* are predetermined to be 40 and the number of teeth of the order shift pinion 7 and the pinion 8 to be respectively 8, the counting operation and zero-reset operation shall be explained. FIG. 1 and FIG. 2 are showing the status in which the zero reset operation has ended. In this state, when the driving wheel 10 is rotated to the predetermined direction, as this rotation is transmitted to the digit wheel 3 of the lowest order through the pinions 12, 13, this digit wheel 3 is clockwisely rotated from the position of FIG. 2. At this moment, the regulating tooth $3e_2$ disengages from the short tooth $7c_1$ of the order shift pinion 7 to pass over the thick tooth $7b_1$ and the top of the thick tooth $7b_1$ comes on the controlling face 3*f* same like the thick tooth $7b_2$. On the other hand, the thin tooth $7a_1$ between the thick teeth $7b_1$ and $7b_2$ is under the idling face 3*g*. Accordingly, until the digit wheel 3 ends substantially a full rotation and the regulating tooth $3e_1$ comes to mesh with the pinion 7 as shown in FIG. 5, the order shift pinion 7 will be kept in the locked state and will stay still at the position shown in FIG. 2. Meantime, the digit wheel 3 shows in turn the numerals 1~9 in the indicating window 14. In this mode, when the digit wheel 3 ends substantially a full rotation, the order shift teeth arrive at the position shown in FIG. 5. When the digit wheel 3 further rotated clockwise from the position of FIG. 5 to enter into a second rotation, the driving tooth 3*d* adjacent to the regulating tooth $3e_1$ firstly meshes with the thick tooth $7b_2$ of the order shift pinion 7, another driving tooth 3*d* nextly meshes with the thin tooth $7a_2$ and the regulating tooth $3e_2$ lastly meshes with the thick tooth $7b_3$ and the short tooth $7c_3$, and the order shift teeth $3e_1$, 3*d*, $3e_2$ again arrive at the position as shown in FIG. 2 in respect to the order shift pinion 7. The order shift pinion 7 is meanwhile clockwisely rotated just by 180°, the thin tooth $7a_3$ goes through to the under side of the idling face 3*g* in place of the thin tooth $7a_1$ of FIG. 2. Further, the plate spring 9 is meanwhile pushed up twice by the thick teeth $7b_4$ and $7b_1$ and again stays still in the position illustrated. This 180° rotation of the order shift pinion 7 is transmitted to the digit wheel of a higher order through the rotary shaft 6 and the pinion 8 and makes this rotate by one numeral or by 36°. In this mode, the digit wheel of the second order from the lowest is rotated by one numeral at every one rotation of the digit wheel of the lowest order by the successive rotation of the driving wheel 10, the digit wheel of the third order from the lowest is rotated by one numeral by the action similar to what explained above when the digit wheel of the second order from the lowest gives one rotation, and thereafter the similar action will be repeated to effect the counting. In the above, the explanation was made on the assumption that the number of teeth of the internal gear 3*a* of the digit wheel 3 is 40 and the number of teeth of the order shift pinion 7 and pinion 8 is 8. However, as the one pitch of the internal gear 3*a* may be in general of the divisor of 9°, the number of teeth of the internal gear 3*a* may be 20, 30, 60 or the like without limiting to that of the above mentioned embodiment and the number of teeth of the order shift pinion 7 and pinion 8 may be also predetermined in accordance with it. However, in practice, the number of teeth of these pinions is preferred to be a multiple of 4 including 4 to be advantageous to secure the above mentioned locked state.

The zero resetting operation may be effected by making the shaft 4 clockwisely rotate at the position of FIG. 2 by an outer operation. That is to say, when the shaft 4 is rotated clockwise at the position of FIG. 2, as the zero reset lever 5 is simultaneously moved from the real line position to the chain line position of FIG. 2, all order shift pinions 7 are moved to the position unable to mesh with the order shift teeth 3*d*, $3e_1$, $3e_2$ and all pinions 8 are moved to the position not to mesh with the internal gear 3*a*, and the inner side edge 5*a* meanwhile pushes the eccentric cam 3*c* to turn it to the smallest diameter position regardless of any turning position of it. Accordingly, when the position of the numeral "0" of each digit wheel 3 to be shown in the counted value indicating window 14 is coincided with the smallest diameter position of each eccentric cam 3*c*, each digit wheel 3 will be simultaneously returned to the zero indicating position as shown in FIG. 2. In this mode, when the shaft 4 is released after the end of the zero reset operation, the zero reset lever 5 will be again returned to the real line position of FIG. 2 by the force of the spring not shown to enter into the countable status. In this case, it is needless to say that the lever 11 effects a movement perfectly similar to that of the zero reset lever 5.

Figure 7:
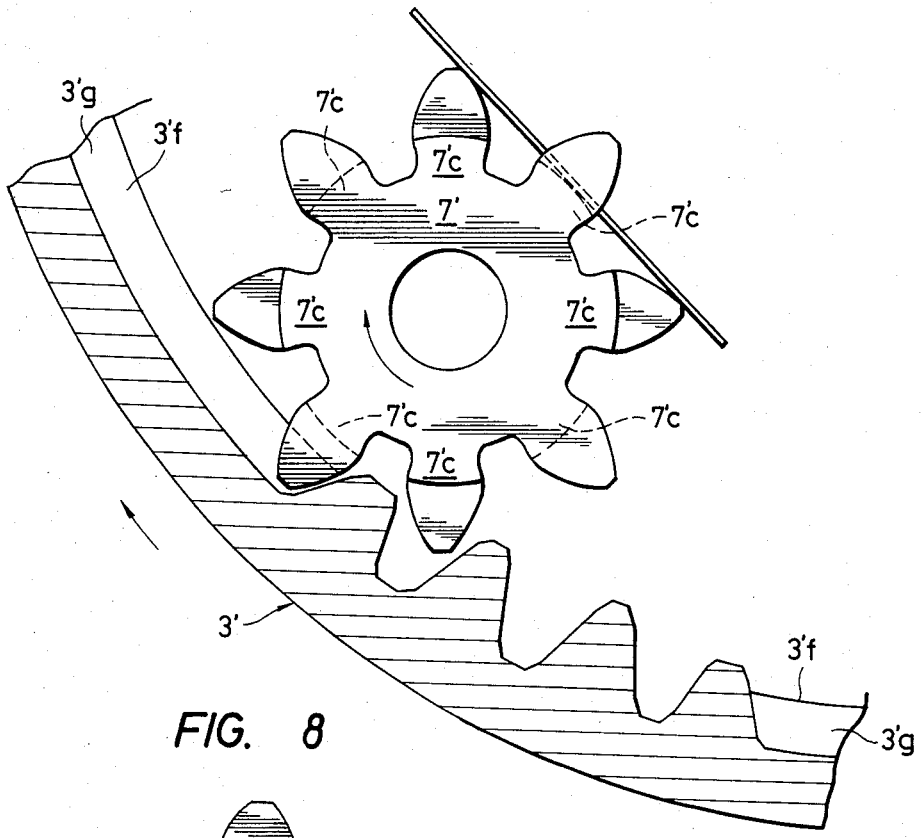
FIG. 7 is a partially enlarged view showing another embodiment of the order shift pinion.
Figure 8:
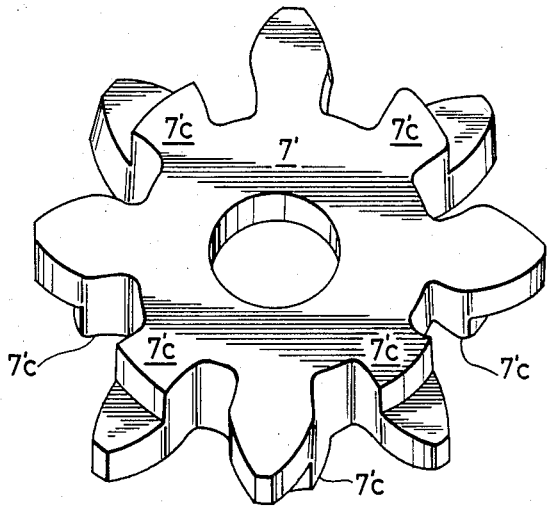
FIG. 8 is a perspective view of the order shift pinion shown in FIG. 7.

FIG. 7 and FIG. 8 show another embodiment of the order shift pinion. This embodiment is different from the above mentioned embodiment in that, as clearly shown in FIG. 8, the half of the thickness of each tooth is deleted to form a short tooth and each short tooth 7′*c* is on the opposite side of the regular teeth adjacent each other. In case the order shift pinion 7′ of this shape is used, as shown in FIG. 7, the idling face 3′*g* will be formed on this side of the control face 3′*f*, but the explanation of the operation thereof will be omitted since the order shift action and the zero reset operation are totally same to the above mentioned case.

Figure 9:
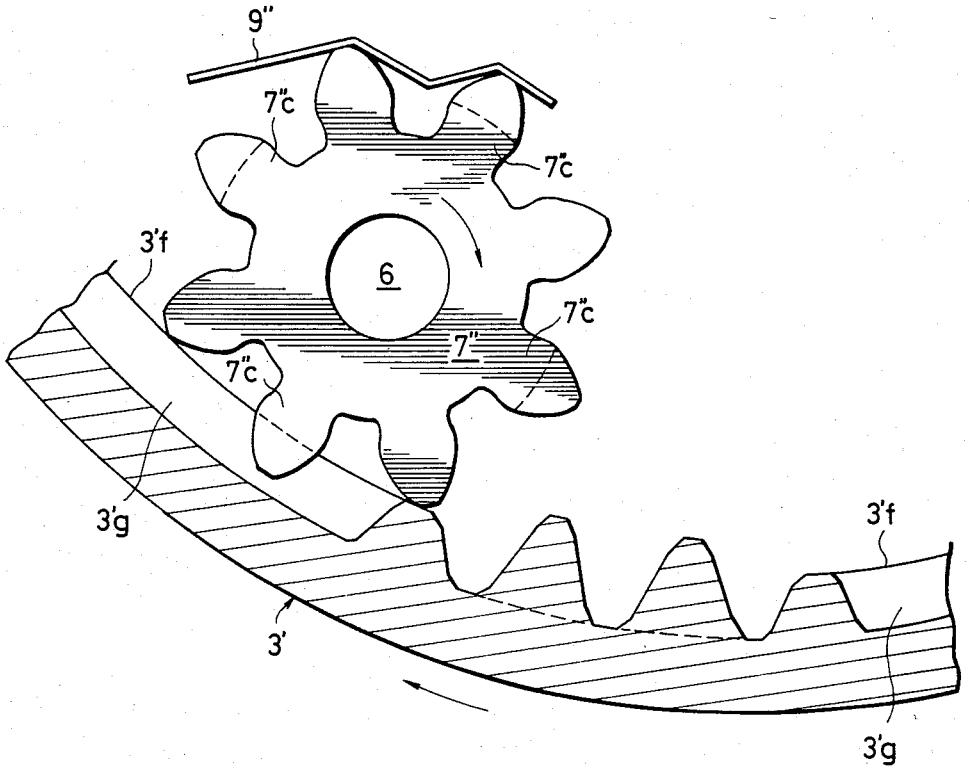
FIG. 9 is a partially enlarged view showing a still another embodiment of the order shift pinion.
Figure 10:
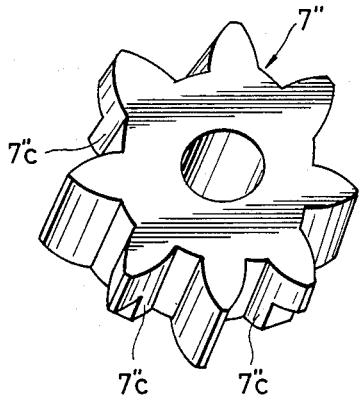
FIG. 10 is a perspective view of the order shift pinion shown in FIG. 9.

FIG. 9 and FIG. 10 show still another embodiment of the order shift pinion. This embodiment is different from the embodiment shown in FIG. 7 and FIG. 8 in that, as clearly shown in FIG. 10, each short tooth 7″*c* is formed at every other regular tooth and the plate spring 9″ is so shaped as to actively function to make sure the 180° rotation of the order shift pinion 7″ during the action. The explanation of the operation thereof will be omitted also in this case since the order shift action and the zero reset action are same to those of the above mentioned case.

I claim:

1. A zero-reset type counter comprising a frame; a supporting shaft mounted on said frame; a plurality of digit wheels rotatably mounted on said supporting shaft, each of said digit wheels having a first annular recess formed with an internal gear on its inner perpheral face on one side thereof and having a second annular recess formed respectively with an eccentric cam on its center portion and order shift teeth on its inner peripheral face on another side thereof; a rotary shaft rotatably mounted on said frame adjacent to said plurality of digit wheels; a plurality of zero reset levers secured on said rotary shaft and interposing respectively between a pair of said digit wheels adjacent each other and engageable to said eccentric cam; a pinion rotatably mounted on said each zero reset lever and engageable with said internal gear; and an order shift pinion so mounted on said each zero reset lever as to be able to rotate integrally with said pinion and engageable with said order shift teeth, the digit wheel of higher order being turned by one numeral through said order shift teeth and order shift pinion when said pinion is meshed with said internal gear and the digit wheel of lower order adjacent to said digit wheel of higher order is fully rotated at counting, and said each zero reset lever being turned in order to simultaneously let said pinion disengage from said each internal gear and said each order shift pinion from said each order shift teeth and to simultaneously and forcibly rotate said each digit wheel to the zero indicating position through said each eccentric cam at zero resetting.

2. A zero-reset type counter according to claim 1, wherein said order shift teeth are consisting of two driving teeth and a pair of regulating teeth adjacent to said driving teeth, said each digit wheel is formed with an idling face and a controlling face along the inner peripheral face between said pair of regulating teeth and the teeth of said each order shift pinion are so thinly formed every other tooth as to be able to ride on said idling face in order to make the tops of paired teeth adjacent to the thin teeth of said order shift pinion able to be engaged to said controlling face except at the order shift.

3. A zero-reset type counter according to claim 1 or 2, wherein said internal gear has forty teeth and said pinion and order shift pinion have eight teeth, respectively.

4. A zero-reset type counter according to claim 1 or 2, wherein said each zero reset lever is so formed as to be able to fill up the gap between a pair of said digit wheels adjacent each other.

* * * * *